US008857978B2

(12) United States Patent
Mitsuya

(10) Patent No.: US 8,857,978 B2
(45) Date of Patent: Oct. 14, 2014

(54) PAPER CONVEYANCE DEVICE AND PRINTER

(75) Inventor: Toshiyuki Mitsuya, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 65 days.

(21) Appl. No.: 13/229,600

(22) Filed: Sep. 9, 2011

(65) Prior Publication Data

US 2012/0062676 A1 Mar. 15, 2012

(30) Foreign Application Priority Data

Sep. 10, 2010 (JP) ..... 2010-202774
Sep. 10, 2010 (JP) ..... 2010-202775

(51) Int. Cl.
*B41J 2/01* (2006.01)
*B41J 11/06* (2006.01)
*B41J 15/04* (2006.01)

(52) U.S. Cl.
CPC . *B41J 11/06* (2013.01); *B41J 15/04* (2013.01)
USPC ..... 347/105

(58) Field of Classification Search
CPC ..... B41J 2/01
USPC ..... 347/105
See application file for complete search history.

(56) References Cited

U.S. PATENT DOCUMENTS

| | | | | |
|---|---|---|---|---|
| 5,874,979 | A | 2/1999 | Ohyama | |
| 7,252,356 | B2 * | 8/2007 | Ide et al. | 347/12 |
| 2003/0103132 | A1 * | 6/2003 | Oshima et al. | 347/153 |
| 2003/0142191 | A1 * | 7/2003 | Rasmussen et al. | 347/104 |

FOREIGN PATENT DOCUMENTS

| | | | |
|---|---|---|---|
| JP | 09-048161 | A | 2/1997 |
| JP | 2006-232470 | A | 9/2006 |
| JP | 2009-119574 | A | 6/2009 |

* cited by examiner

*Primary Examiner* — Alessandro Amari
*Assistant Examiner* — Alexander C Witkowski
(74) *Attorney, Agent, or Firm* — Kilpatrick Townsend & Stockton LLP

(57) ABSTRACT

A paper conveyance device for a printing device that prints information using a printhead on conveyed continuous paper R, including a paper conveyance mechanism that holds and conveys the continuous paper to the print area of the printhead, and a guide unit that has two guide surfaces facing the conveyed continuous paper. The guide unit has a plurality of ribs that are disposed to at least one of the two guide surfaces with a specific gap therebetween in the direction perpendicular to the conveyance direction, protrude to the continuous paper side, and extend in the conveyance direction. The rib located in the middle of the width of the conveyed continuous paper being the longest of the plural ribs in the conveyance direction, and the length in the conveyance direction of the other ribs becoming gradually shorter with proximity to the sides of the continuous paper width.

10 Claims, 10 Drawing Sheets

PAPER CONVEYANCE DEVICE AND PRINTER

BACKGROUND

1. Technical Field

The present invention relates to a paper conveyance device for recording media on which information is recorded, and to a printer having the paper conveyance device.

The present application claims priority based on and incorporates by reference the entire contents of Japanese Patent Application No. 2010-202774 filed in Japan on Sep. 10, 2010, and No. 2010-202775 filed on Sep. 10, 2010.

2. Related Art

Printers are used for recording information in business and many other fields. As a result, many different kinds of recording media are also used for recording information. These recording media include multipart forms composed of plural sheets. This type of recording medium is typically supplied as fanfold paper. Fanfold paper has sprocket holes (conveyance holes) formed in the conveyance direction, is perforated between each page so that the pages can be easily separated, and is stored in a stack with the pages alternately folded in opposite directions at the perforations. Fanfold paper is conveyed by a paper conveyance mechanism with a tractor.

The tractor has tractor pins that can be inserted in the sprocket holes of the fanfold paper, and a tractor belt having the tractor pins formed with a specific interval therebetween on the outside surface. The fanfold paper is set so that the tractor pins are inserted in the sprocket holes. The tractor causes the tractor belt to turn by means of drive power from a drive source, and conveys the continuous paper while causing the tractor pins to sequentially engage the sprocket holes of the continuous paper. See, for example, Japanese Unexamined Patent Appl. Pub. JP-A-2006-232470.

The paper conveyance device of a business printer that records information on continuous paper has a paper feed roller and a pressure roller near the printhead in addition to the tractor described above, and feeds the continuous paper in increments of a specific feed distance by synchronously driving the paper feed roller and the tractor See, for example, Japanese Unexamined Patent Appl. Pub. JP-A-2009-119574.

Printers record information on a conveyed recording medium using a printhead. To achieve better print quality, the recording medium must be conveyed appropriately. If the conveyed recording medium is wrinkled or puckered (does not lie flat), a desirable relationship between the printhead and the recording medium is not maintained and print quality may suffer. To prevent wrinkles and bulges in the recording medium, Japanese Unexamined Patent Appl. Pub. JP-A-H09-48161 teaches an inkjet printer that creates lands and grooves by means of ribs throughout the recording medium conveyance path, and corrects bulging and separation of the recording medium from the platen.

There are now many different types of recording media and many different types of printers. When the recording medium is a multipart form having plural sheets with adhesive applied along both edges in the conveyance direction, the sheets can contract and wrinkle due to humidity and other environmental effects. When multiple sheets of different materials are combined, the sheets contract at different rates and one sheet may wrinkle much more than the other. When printing to such recording media with a printer such as an inkjet printer, an appropriate gap cannot be maintained between the printhead and the recording medium, and print quality drops. In extreme cases the recording medium may touch the printhead, and normal printing may not be possible. In addition, when a paper feed mechanism with rollers is disposed near the printhead and the pressure roller is used to correct such problems, the roller may crush the wrinkled part and create a creased wrinkle.

The inkjet printer that corrects paper wrinkles by means of full-surface ribs as taught in JP-A-H09-48161 describes correcting wrinkles in single-sheet paper, and is silent regarding correcting the severe wrinkles and media bubbles that can occur when plural sheets are combined in a multipart form as in the recording medium described above.

SUMMARY

The present invention is directed to solving at least part of the foregoing problem, and can be achieved by the embodiments and examples described below.

A first aspect of the invention is a paper conveyance device for a printing device that prints information using a printhead on conveyed continuous paper, including: a paper conveyance mechanism having a paper feed roller and a pressure roller that hold and convey the continuous paper to the print area of a printhead; and a guide unit that has two guide surfaces facing the continuous paper conveyed by the paper conveyance mechanism, and a plurality of ribs that are disposed to at least one of the two guide surfaces with a specific gap therebetween in the direction perpendicular to the conveyance direction, protrude to the continuous paper side, and extend in the conveyance direction, the rib located in the middle of the width of the conveyed continuous paper being the longest of the plural ribs in the conveyance direction, and the length in the conveyance direction of the other ribs becoming gradually shorter with proximity to the sides of the continuous paper width.

Preferably, the plural ribs sequentially include the rib located in the center of the continuous paper width as a first rib, two second ribs that are shorter than the first rib disposed with a specific gap to the first rib in the direction perpendicular to the continuous paper conveyance direction, and two third ribs that are shorter than the second ribs disposed with a specific gap to the second ribs in the direction perpendicular to the continuous paper conveyance direction.

With a paper conveyance device according to these aspects of the invention, puckering of the conveyed continuous paper is gradually deflated and dispersed to a number of smaller bulges by the first rib of the paper conveyance device located in the middle of the paper width, and by the second ribs and third ribs that are gradually shorter in the conveyance direction and disposed with a specific gap between ribs in the direction perpendicular to the conveyance direction. As a result, even if bubbles or wrinkles occur in the paper, the height thereof can be reduced and spread evenly. A suitable gap can therefore be maintained between the printhead and the continuous paper. A drop in print quality can therefore be prevented.

Further preferably in another aspect of the invention, of the two guide surfaces of the guide unit, the plural ribs are disposed to the guide surface opposite the printing surface of the continuous paper.

This aspect of the invention enables the paper conveyance device to break wrinkles and puckering of the printing surface of the continuous paper into multiple small parts. As a result, an appropriate gap can be maintained between the printhead and the printing surface of the continuous paper.

Further preferably in a paper conveyance device according to another aspect of the invention, the gap between the ribs and the other guide surface decreases in the main conveyance direction of the continuous paper.

This aspect of the invention gradually corrects wrinkles and bubbles in the continuous paper as the paper is conveyed through the paper conveyance device. As a result, paper feed problems caused by wrinkles or puckering of the continuous paper inside the paper conveyance device can be reduced.

Further preferably in a paper conveyance device according to another aspect of the invention, the pressure roller of the paper conveyance mechanism is segmented into a plurality of rollers across the width of the conveyed continuous paper; and the plural rollers are disposed to positions corresponding to the plural ribs rendered on the guide surface.

The paper conveyance device according to this aspect of the invention breaks up bubbles and wrinkles in the continuous paper by means of the plural ribs, and has a pressure roller disposed where the ribs are located. The pressure roller can therefore be disposed outside the wrinkled part of the continuous paper. As a result, the pressure roller can be prevented from flattening the wrinkled part and creating creased folds in the paper. A drop in print quality caused by creases in the continuous paper can therefore be prevented.

A paper conveyance device for a printing device that prints information using a printhead on conveyed continuous paper according to another aspect of the invention includes: a paper conveyance mechanism that conveys the continuous paper to the area where the printhead is located; and a guide unit that has two guide surfaces facing the continuous paper conveyed by the paper conveyance mechanism, and a shoulder that is disposed to at least one of the two guide surfaces, protrudes to the continuous paper side, and has a continuous paper contact area that when seen in plan view has a peak on the upstream side in the conveyance direction and gradually increases in the downstream direction.

With this aspect of the invention, puckering on the printing surface side of the conveyed continuous paper is pushed out to the sides of the paper width by means of the shoulder. The shoulder is located in the middle of the paper width, protrudes toward the continuous paper side, is basically triangular with the peak on the upstream side in the conveyance direction, and gradually increases in width in the downstream direction. Puckering and wrinkles in the continuous paper thus gradually move from the print area of the continuous paper to the non-printing areas at the sides of the paper width. As a result, an appropriate gap between the printhead and the continuous paper can be maintained in the print area, and creases caused by the wrinkles being flattened and crushed can be prevented. A drop in print quality caused by puckering or creases in the continuous paper can therefore be prevented.

In a paper conveyance device according to another aspect of the invention, of the two guide surfaces of the guide unit, the shoulder is disposed to the guide surface opposite the printing surface of the continuous paper.

A paper conveyance device according to this aspect of the invention can divide a bubble in the printing surface of the continuous paper into two smaller parts at the sides of the paper width. As a result, an appropriate gap can be maintained between the printhead and the printing surface of the continuous paper.

Further preferably in a paper conveyance device according to another aspect of the invention, the continuous paper is composed of two sheets that are bonded by adhesive at the widthwise edges.

In a paper conveyance device according to another aspect of the invention, the continuous paper is composed of two sheets of different materials that are bonded by adhesive at the widthwise edges.

A paper conveyance device according to these aspects of the invention can break a large bubble or wrinkle in the continuous paper caused by environmental factors such as humidity into multiple small wrinkles. As a result, an appropriate gap can be maintained between the printhead and the continuous paper even when using multipart continuous paper composed of sheets of different types of materials. A drop in print quality can therefore be prevented.

Another aspect of the invention is a printing device including the paper conveyance device described above, a printhead that discharges ink droplets onto continuous paper conveyed by the paper conveyance device, a carriage that carries the printhead, and a carriage moving mechanism that moves the carriage bidirectionally perpendicularly to the conveyance direction of the paper conveyance device.

A printing device according to this aspect of the invention can prevent a drop in print quality caused by puckering, wrinkling, or creasing of the continuous paper.

DESCRIPTION OF EMBODIMENTS

A preferred embodiment of the invention is described below with reference to the accompanying figures. Note that for convenience of description and illustration, the horizontal and vertical scale of members and parts may be shown as different from the actual scale in the figures referenced in the following description. Note that an inkjet printer that prints by ejecting ink droplets onto paper is used as an example of a printing device in the embodiment described below.

General Configuration of an Inkjet Printer

Figure 1:
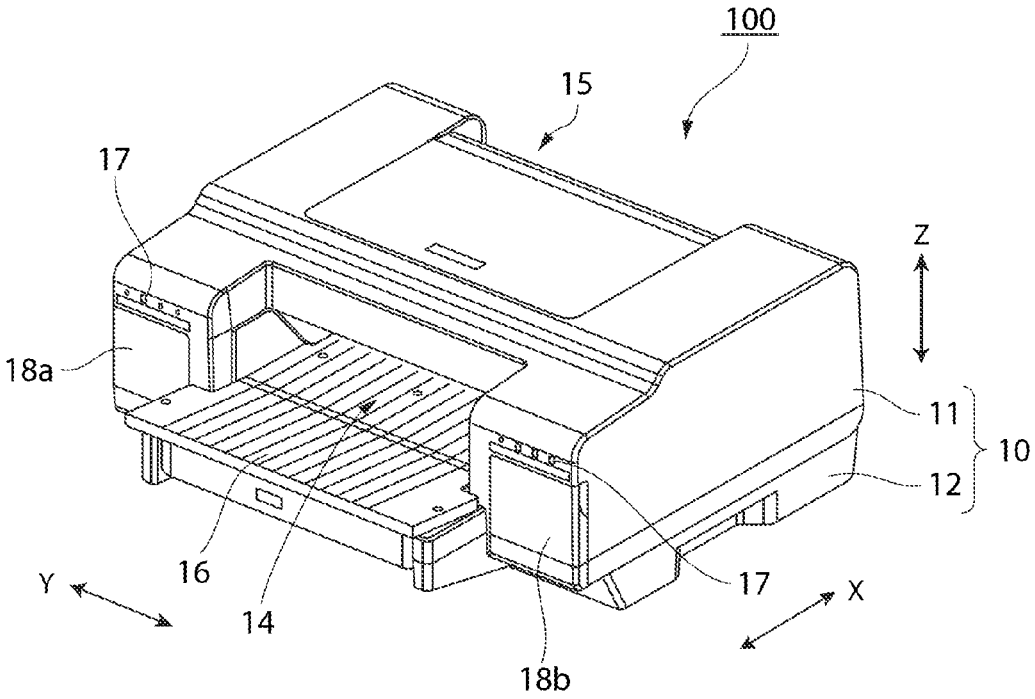
FIG. 1 is an external oblique view of an inkjet printer.

The general configuration of an inkjet printer is described next with reference to FIG. 1. FIG. 1 is an external oblique view of an inkjet printer. Note that the x-axis shown in FIG. 1 denotes the paper feed direction of the continuous paper, the y-axis indicates the direction of the width of the continuous paper, and the z-axis indicates the axis perpendicular to the x-axis and y-axis.

An inkjet printer 100 according to this embodiment of the invention is a business printer of a type that supplies fanfold paper used as continuous paper from the back side of the printer and discharges the paper from the front of the printer. As shown in FIG. 1, the inkjet printer 100 stores the print unit 110 (see FIG. 2) described below inside a case 10 composed of a top case 11 and a bottom case 12. A paper exit 14 opens to the front center of the case 10 as seen in the figure, and a paper supply opening 15 is rendered behind the paper exit 14 on the x-axis. A discharge tray 16 that receives the continuous paper after printing is completed is disposed to the paper exit 14. A display unit 17 composed of LED indicators, for example, for displaying the operating state is disposed to the front of the case 10 on both sides on the y-axis.

An ink cover 18*a* that covers the front of the cartridge storage unit 22*a* that stores a black ink cartridge 21*a* (see FIG. 2), and an ink cover 18*b* that covers the front of a cartridge storage unit 22*b* that stores a plurality of color ink cartridges 21*b*, are disposed on the left and right sides below the display unit 17 on the z-axis. These ink covers 18*a*, 18*b* are attached so that they can open and close, and the ink cartridges 21*a*, 21*b* can be replaced by opening the respective ink covers 18*a*, 18*b*.

Configuration of the Print Unit

Figure 2:
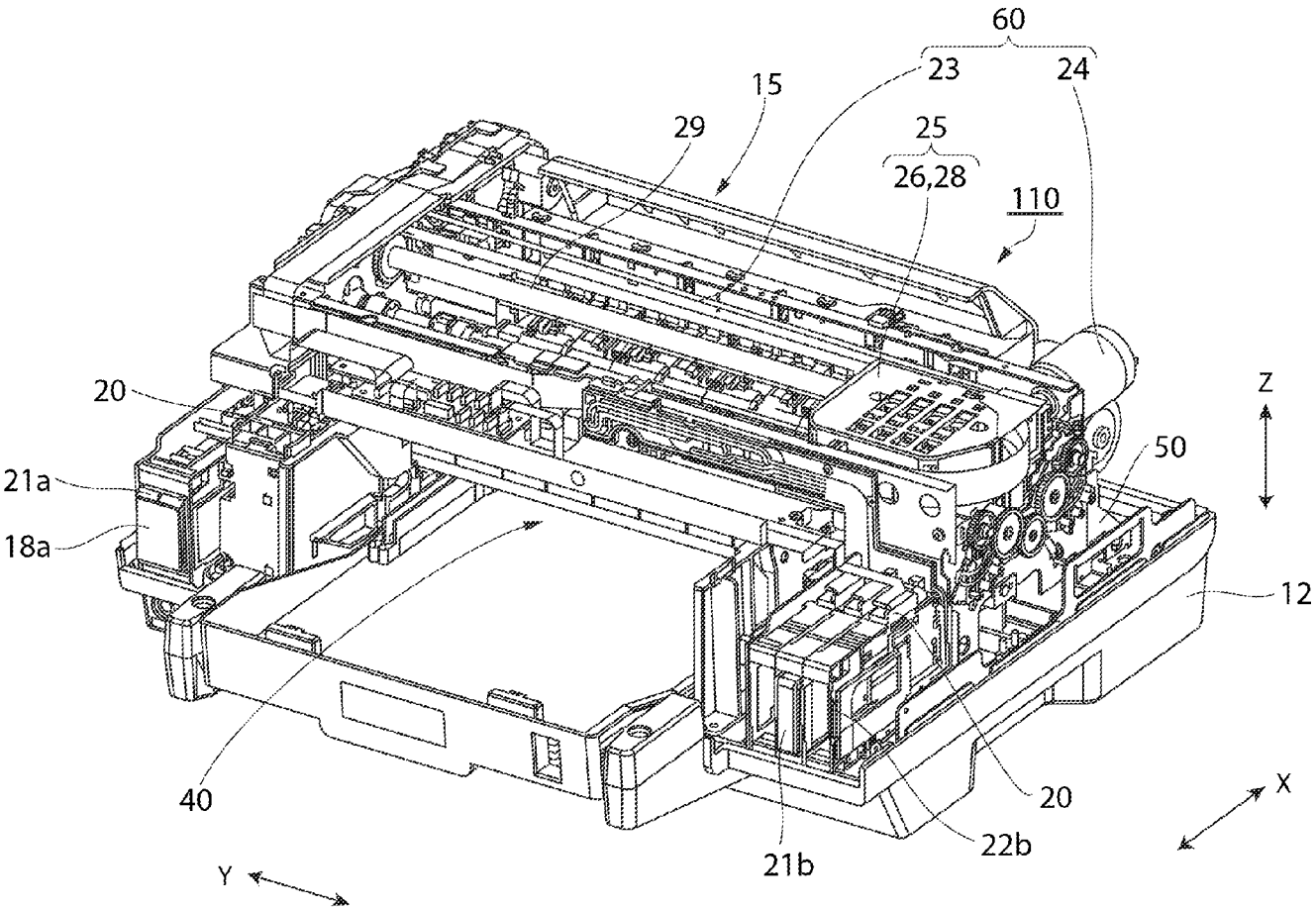
FIG. 2 is an oblique view of the print unit.

The configuration of the print unit housed in the case is described next with reference to FIG. 2. FIG. 2 is an oblique view of the print unit. Note that the x-axis, y-axis, and z-axis shown in FIG. 2 denote the same directions as the x-axis, y-axis, and z-axis shown in FIG. 1.

As shown in FIG. 2, the print unit 110 has an ink supply mechanism 20, a print mechanism 25, a paper conveyance device 40, a chassis 50, a waste ink tank not shown, and a control device not shown.

The ink supply mechanism 20 includes cartridge storage units 22*a*, 22*b* that hold the ink cartridges 21*a*, 21*b*, an ink pressurization unit not shown, and an ink supply tube that is also not shown. The cartridge storage units 22*a*, 22*b* are respectively disposed behind the foregoing ink covers 18*a*, 18*b*. Ink from the ink cartridges 21*a*, 21*b* stored in the cartridge storage units 22*a*, 22*b* is pressurized by the ink pressurization unit and supplied through the ink supply tube to the print mechanism 25.

The print mechanism 25 includes an inkjet head 26, carriage 28, carriage drive mechanism 60, and maintenance mechanism not shown. The inkjet head 26 has a plurality of nozzles 27 (see FIG. 3) that eject ink supplied by the ink supply mechanism 20 as ink droplets, and is mounted on the carriage 28 with the nozzles 27 facing down on the z-axis in FIG. 2, that is, facing the paper. The carriage 28 is movably supported on a carriage shaft 29 that extends in the direction of the paper width (the y-axis), and is moved bidirectionally on the y-axis by the carriage drive mechanism 60. The carriage drive mechanism 60 includes a carriage motor 24, and a timing belt 23 that is driven by the carriage motor 24. The carriage 28 is attached to the timing belt 23, and therefore moves bidirectionally in the paper width direction (y-axis) in conjunction with timing belt 23 travel.

The maintenance mechanism includes a suction unit not shown and a wiper unit also not shown. The maintenance mechanism can set the suction unit and wiper unit opposite the inkjet head 26 on the carriage 28 by moving the carriage 28 on the y-axis. The suction unit functions to seal the nozzle 27 face of the inkjet head 26 when not printing to prevent the nozzles 27 from drying, and suction ink that has increased in viscosity from the nozzles 27 of the inkjet head 26. The wiper unit functions to wipe waste from the nozzle 27 face of the inkjet head 26. The waste ink tank has a piece of felt or other non-woven cloth, is disposed at the bottom of the print unit 110, and stores waste ink removed by the suction unit.

Configuration of the Paper Conveyance Device

Embodiment 1

Figure 3:
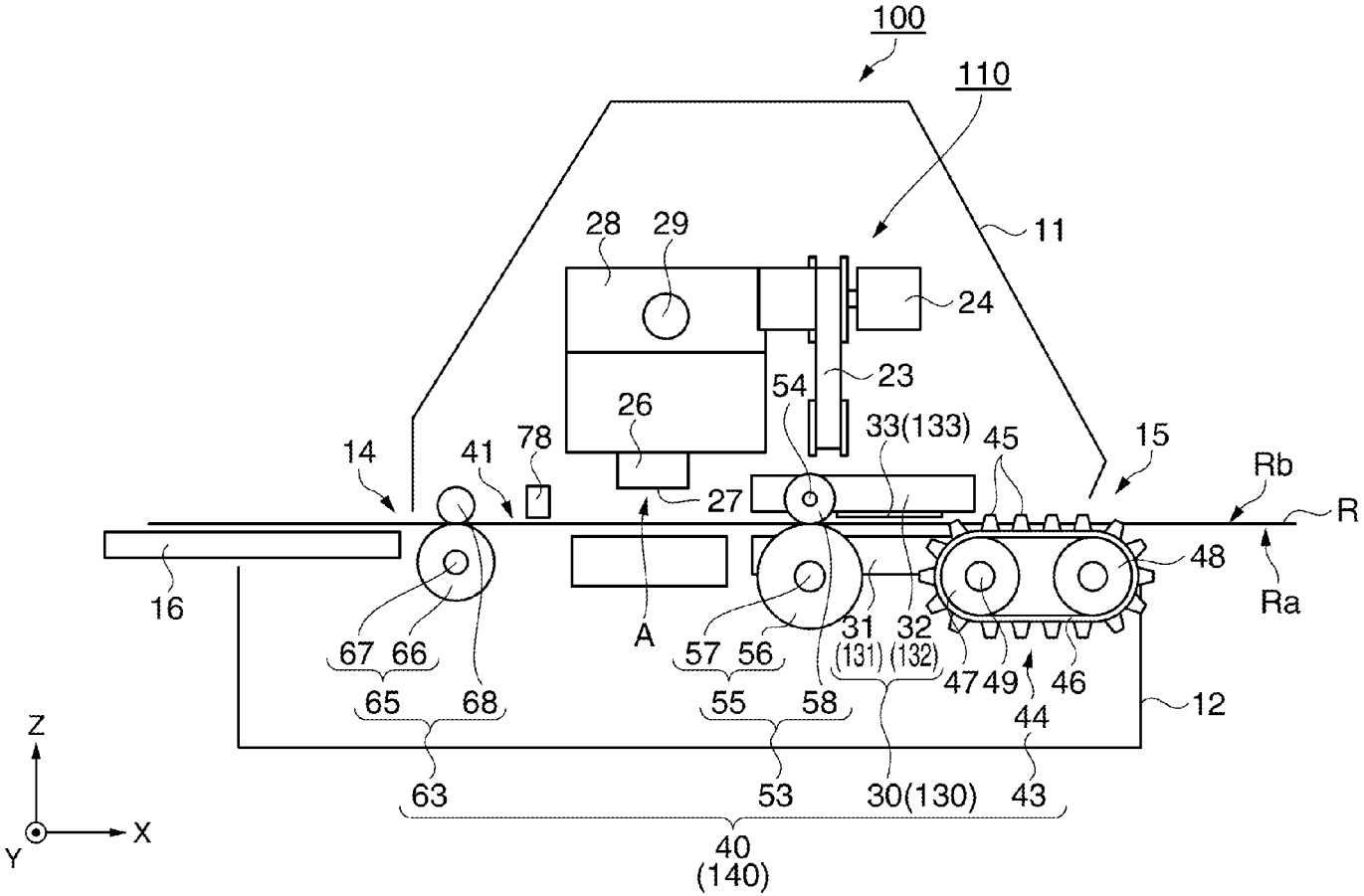
FIG. 3 schematically shows the configuration of the paper conveyance device.
Figure 4A:
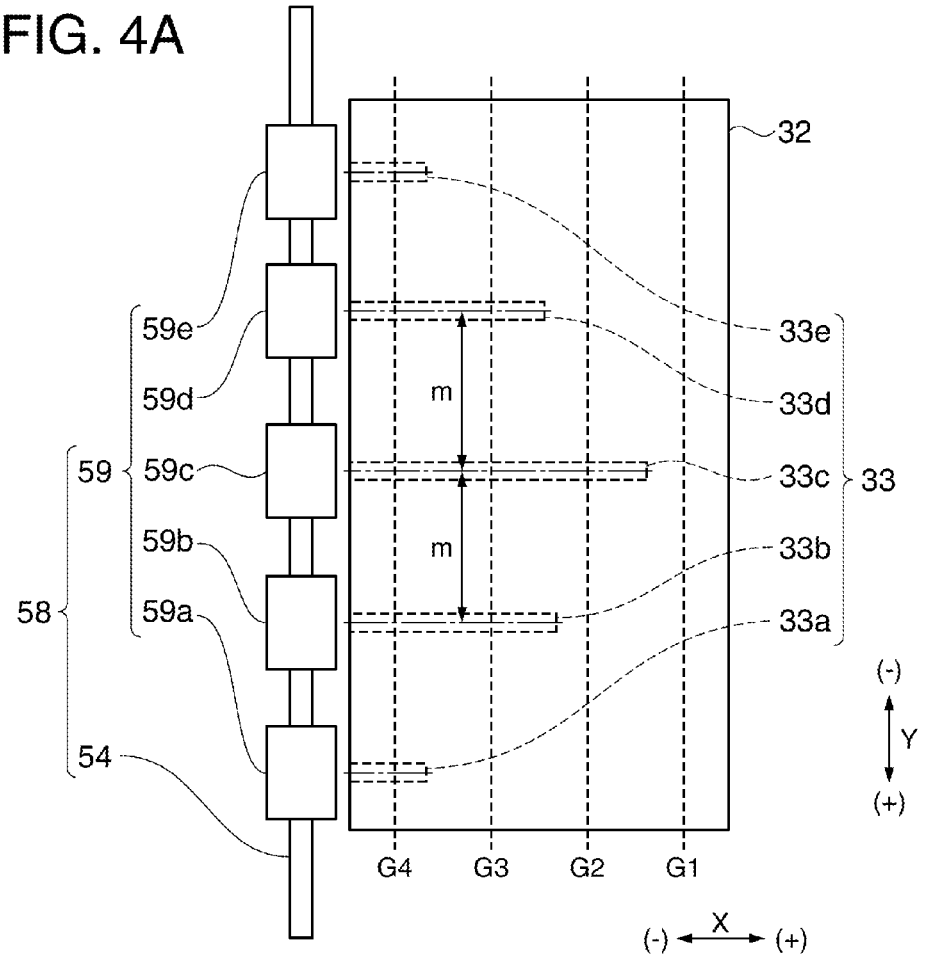
FIG. 4 describes a guide unit according to a first embodiment of the invention.
Figure 4B:
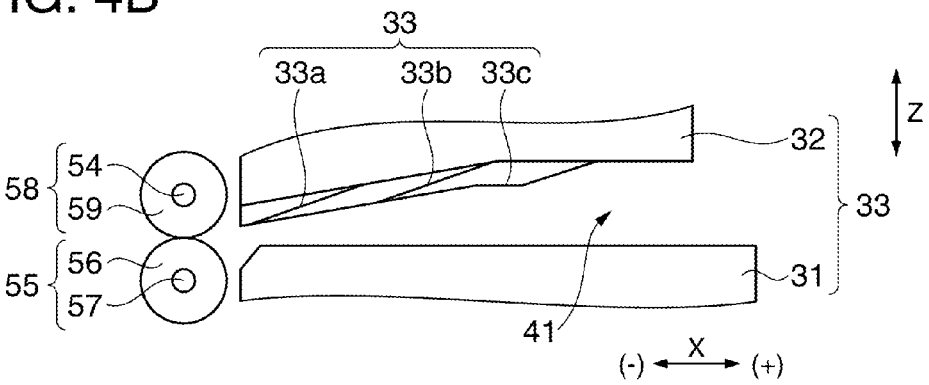
Figure 5:
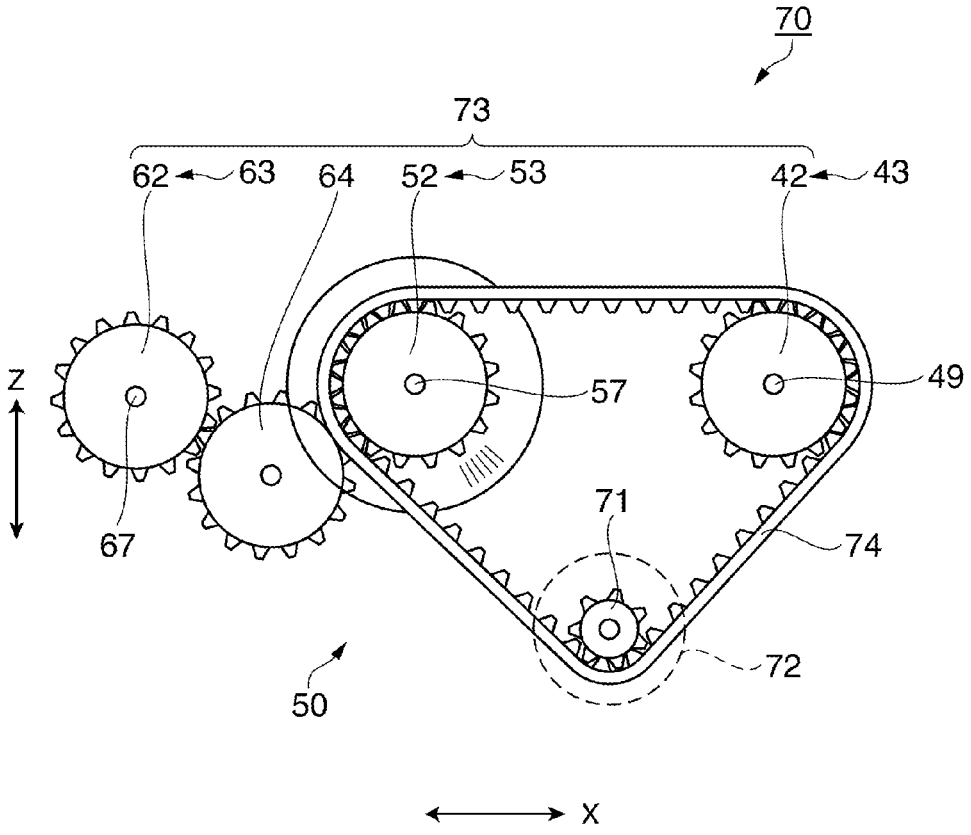
FIG. 5 describes the power transfer mechanism of the paper conveyance device.

The configuration of a paper conveyance device according to a first embodiment of the invention is described next with reference to FIG. 3 to FIG. 5. FIG. 3 schematically shows the configuration of the paper conveyance device, and FIG. 4 a guide unit according to the first embodiment of the invention. FIG. 4A is a plan view of the area around the guide unit, and FIG. 4B is a side view of the area around the guide unit. FIG. 5 shows the configuration of the power transfer mechanism of the paper feed direction. Note that the x-axis, y-axis, and z-axis shown in FIG. 3 to FIG. 5 denote the same directions as the x-axis, y-axis, and z-axis shown in FIG. 1. Note also that this paper conveyance device conveys continuous paper R that has sprocket holes.

As shown in FIG. 3, the paper conveyance device 40 has a paper conveyance path 41, a guide unit 30, a first conveyance mechanism 43, a second conveyance mechanism 53, a third conveyance mechanism 63, and a power transfer mechanism 70 (see FIG. 5). The paper conveyance path 41 is formed along the x-axis shown in FIG. 3 starting from the paper supply opening 15 of the inkjet printer 100 and print unit 110 shown in FIG. 1 and FIG. 2, passing the printing position A of the inkjet head 26 of the print mechanism 25, and ending at the paper exit 14. Disposed along the paper conveyance path 41 sequentially from the upstream side to the downstream side are the first conveyance mechanism 43, guide unit 30, second conveyance mechanism 53, print mechanism 25, and third conveyance mechanism 63.

The first conveyance mechanism 43 is disposed near the paper supply opening 15, and has a pair of tractors 44. Each tractor 44 has tractor pins 45 (engaging units) that can be inserted to the sprocket holes Q1 of the continuous paper R, a tractor belt 46 on the outside surface of which the tractor pins 45 are formed at a regular interval, and a drive sprocket 47 and follower sprocket 48 on which the tractor belt 46 is mounted. The pair of tractors 44 is disposed on both sides of the paper conveyance path 41 on the y-axis opposite the sprocket holes Q1 on both sides of the width of the conveyed continuous paper R. The drive sprockets 47 of the tractor 44 pair are connected to each other by a drive sprocket shaft 49 so that the pair of tractors 44 are driven synchronously. A drive gear 42 (see FIG. 5) is attached to an end of the drive sprocket shaft 49 so that it is exposed from one outside surface of the chassis 50.

The guide unit 30 includes a bottom guide 31 that guides the bottom surface Ra of the conveyed continuous paper R, and a top guide 32 that guides the top surface Rb of the continuous paper R and is disposed opposite the bottom guide 31 with a specific gap therebetween on the z-axis. A plurality of ribs 33 that are rectangular in section are disposed to the top guide 32 extending in the conveyance direction (x-axis) of the continuous paper R.

As shown in FIG. 4A, a plurality of ribs 33, such as five in this embodiment of the invention, are disposed with a specific gap m therebetween in the direction (y-axis) perpendicular to the conveyance direction (x-axis). These five ribs 33 are labeled 33*a*, 33*b*, 33*c*, 33*d*, and 33*e* sequentially from the Y(+) side.

Of the plural ribs 33, the rib 33*c* positioned in the center of the width of the conveyed continuous paper R has the greatest length in the x-axis direction. More specifically, referenced to the end at the downstream end in the conveyance direction (the X(−) direction), the ribs are formed extending upstream in the conveyance direction (the X(+) direction). The ribs 33*b* and 33*d* positioned on opposite sides of center rib 33*c* on the y-axis are a specific length shorter than the center rib 33*c* referenced to the same starting position. The ribs 33*a* and 33*e* positioned outside the ribs 33*b*, 33*d* on the y-axis, that is, closest to the side edges of the continuous paper R, are a specific length shorter than the ribs 33*b*, 33*d* referenced to the same starting position. As a result, the ends of the ribs 33*a*, 33*b*, 33*c*, 33*d*, and 33*e* in the X(+) direction form a triangle with the peak upstream in the conveyance direction. In addition, as shown in FIG. 4B, the surface in the Z(−) direction of the ribs 33*a*, 33*b*, 33*c*, 33*d*, and 33*e* disposed to the top guide 32 is sloped so that the gap to the bottom guide 31 decreases from the X(+) side to the X(−) side, that is, the main conveyance direction of the continuous paper R.

As shown in FIG. 3, the second conveyance mechanism 53 is disposed to the paper conveyance path 41 between the first conveyance mechanism 43 and the printing position A of the inkjet head 26, and more specifically downstream from the foregoing guide unit 30. The second conveyance mechanism 53 has a first paper feed roller 55 and a first pressure roller 58. The first paper feed roller 55 is composed of a cylindrical roller 56 made from a rubber elastic body or a sintered body with a powder coating, and a roller shaft 57 that passes axially through the roller 56, and is disposed transversely to the paper conveyance path 41 below the paper conveyance path 41 on the z-axis. The drive gear 52 (see FIG. 5) is disposed to one end of the roller shaft 57 so that it is exposed outside of one side of the chassis 50.

As shown in FIG. 4A, the first pressure roller 58 includes a plurality of cylindrical rollers 59 made of plastic or an elastic body such as rubber, and a roller shaft 54 that passes axially through the plural rollers 59. In this embodiment of the invention five rollers 59 are disposed at a specific pitch on the y-axis. Sequentially from the Y(+) side, these five rollers 59 are labelled rollers 59*a*, 59*b*, 59*c*, 59*d*, and 59*e*. The rollers 59 are positioned on the y-axis so that roller 59*a* is positioned opposite rib 33*a*, roller 59*b* is positioned opposite rib 33*b*, roller 59*c* is opposite rib 33*c*, roller 59*d* is opposite rib 33*d*, and roller 59*e* is opposite rib 33*e*. The first pressure roller 58, that is, rollers 59*a*, 59*b*, 59*c*, 59*d*, 59*e*, are disposed to press the continuous paper R conveyed through the paper conveyance path 41 to the first paper feed roller 55 by means of an urging force from above on the z-axis.

As shown in FIG. 3, the third conveyance mechanism 63 is disposed along the paper conveyance path 41 between the printing position A of the inkjet head 26 and the paper exit 14, and more specifically slightly to the inkjet head 26 side. The third conveyance mechanism 63 has a second paper feed roller 65 and a second pressure roller 68. The second paper feed roller 65 includes a cylindrical roller 66 made from a rubber elastic body or a sintered body with a powder coating, and a roller shaft 67 that passes axially through the cylindrical roller 66, and is disposed transversely to the paper conveyance path 41 below the paper conveyance path 41 on the z-axis. A drive gear 62 (see FIG. 5) is attached to one end of the roller shaft 67 so that it is exposed from one outside surface of the chassis 50.

The second pressure roller 68 is a toothed roller that is segmented into plural parts made by sheet metal processing metal sheets into star shapes, and is disposed to press the continuous paper R fed through the paper conveyance path 41 to the second paper feed roller 65 by means of urging force from above on the z-axis. A paper detector 78 is disposed between the second pressure roller 68 and the inkjet head 26. The paper detector 78 is a reflective photosensor, for example, and detects the presence and the leading edge or the trailing edge of continuous paper R conveyed through the paper conveyance path 41 by the paper conveyance device 40.

As shown in FIG. 5, the power transfer mechanism 70 includes a paper feed motor 72 with a motor gear 71 as the drive source, a gear train 73, and a toothed belt 74, and is disposed outside the chassis 50 on one side on the y-axis. The paper feed motor 72 is fastened to the chassis 50 so that the motor gear 71 is exposed outside one side of the chassis 50. As a result, the motor gear 71 and the gear train 73 including the drive gear 42 described above, the drive gear 52, and the drive gear 62 are disposed outside one side of the chassis 50. The toothed belt 74 is an endless belt with internal teeth, and is mounted with specific tension to the motor gear 71, the drive gear 42 of the first conveyance mechanism 43, and the drive gear 52 of the second conveyance mechanism 53. The drive gear 62 of the third conveyance mechanism 63 engages the drive gear 52 of the second conveyance mechanism 53. Note that a tension roller could be used with the toothed belt 74 to maintain appropriate tension.

The paper conveyance device 40 configured as described above transfers the drive power of the paper feed motor 72 from the motor gear 71 through the toothed belt 74 to the drive gear 42 of the first conveyance mechanism 43 and the drive gear 52 of the second conveyance mechanism 53, and to the drive gear 62 of the third conveyance mechanism 63 through the drive gear 52 of the second conveyance mechanism 53. Note that the paper feed motor 72 is controlled based on a control signal from the control device 80 described below.

The paper conveyance device 40 conveys continuous paper R with sprocket holes Q1 that are engaged by the tractor pins 45 along the paper conveyance path 41 by rotationally driving the tractors 44 of the first conveyance mechanism 43. The continuous paper R conveyed by the first conveyance mechanism 43 is gradually corrected by the guide unit 30, or more specifically by the plural ribs 33*a*, 33*b*, 33*c*, 33*d*, and 33*e* of the top guide 32, is delivered between the rotating first paper feed roller 55 and first pressure roller 58 of the second conveyance mechanism 53, and is further conveyed through the paper conveyance path 41. The continuous paper R conveyed by the second conveyance mechanism 53 is fed passed the printing position A of the print mechanism 25 to between the rotating second paper feed roller 65 and second pressure roller 68 of the third conveyance mechanism 63, and is sequentially conveyed through the paper conveyance path 41 toward the paper exit 14.

Continuous Paper

The continuous paper used in the foregoing inkjet printer is described next with reference to FIG. 6. FIG. 6 shows examples of continuous paper, 6A showing a single prescription bag, 6B showing prescription bags as continuous paper, and 6C showing fanfold paper as continuous paper. Note that the x-axis, y-axis, and z-axis shown in FIG. 6 denote the same directions as the x-axis, y-axis, and z-axis shown in FIG. 1.

Figure 6A:
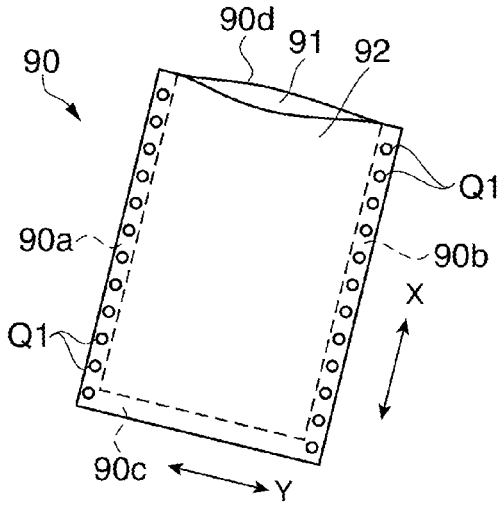
FIG. 6 shows an example of continuous paper.

A prescription bag 90 is a paper bag used to hold prescription drugs received from a hospital or pharmacy for a patient, and has the patient name, drug information, and dosage instructions recorded on the outside. As shown in FIG. 6A, the prescription bag 90 has a double-layered construction including a transparent plastic film sheet 91 and a paper cover sheet 92 made of different materials that are bonded with adhesive along both y-axis edges 90*a*, 90*b* and x-axis bottom edge 90*c*, leaving the x-axis top end 90*d* open. The patient name and other necessary information is printed on the cover sheet 92 by the inkjet printer 100 described above, and the prescriptions stored inside can be seen through the transparent plastic film sheet 91.

Figure 6B:
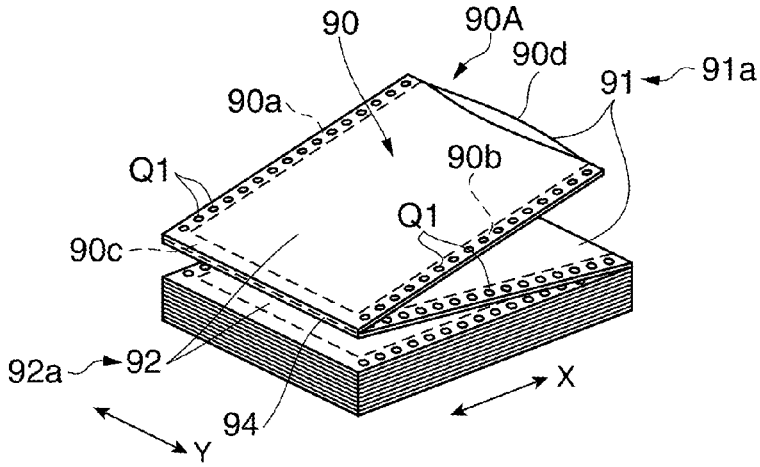

As shown in FIG. 6B, the prescription bags 90 are supplied as continuous prescription bag paper 90A having plural sets of the foregoing prescription bags 90 formed continuously together. More specifically, the transparent plastic film sheet 91 and cover sheet 92 are each single continuous webs 91 a, 92*a*, respectively, that are bonded to each other with adhesive along the edges 90*a*, 90*b* and have sprocket holes Q1 that can be engaged by the tractor pins 45 shown in FIG. 3 formed in a line at a specific pitch along the edges 90*a*, 90*b* on the x-axis. These continuous webs 91*a*, 92*a* can be individually separated at the perforations (separation parts) 94 disposed at specific intervals lengthwise (on the x-axis). The sheets are also bonded with adhesive widthwise on one side of each perforation 94. This bonded part corresponds to the bottom edge 90*c*. The continuous prescription bag paper 90A is alternately folded in opposite directions at the perforations 94 like fanfold paper. Thus configured, the continuous prescription bag paper 90A is conveyed and printed continuously by the inkjet printer 100 having tractors 44.

Figure 6C:
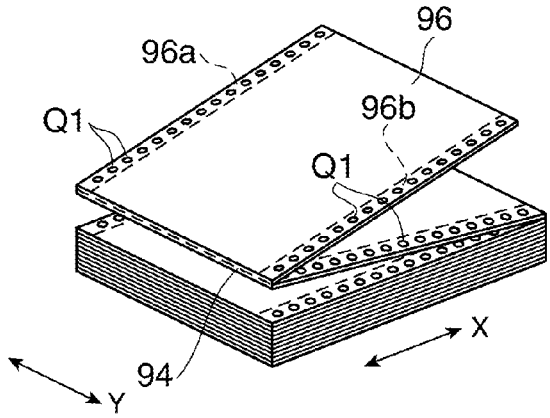

Continuous paper R used in this inkjet printer 100 is not limited to the continuous prescription bag paper 90A described above. As shown in FIG. 6C, plain fanfold paper that has sprocket holes Q1 formed in a row along both y-axis edges 96*a*, 96*b* of the paper at a specific pitch along the x-axis, and can be pulled apart at perforations 94 rendered at specific intervals in the x-axis direction, may also be used.

Inkjet Printer Control

Figure 7:
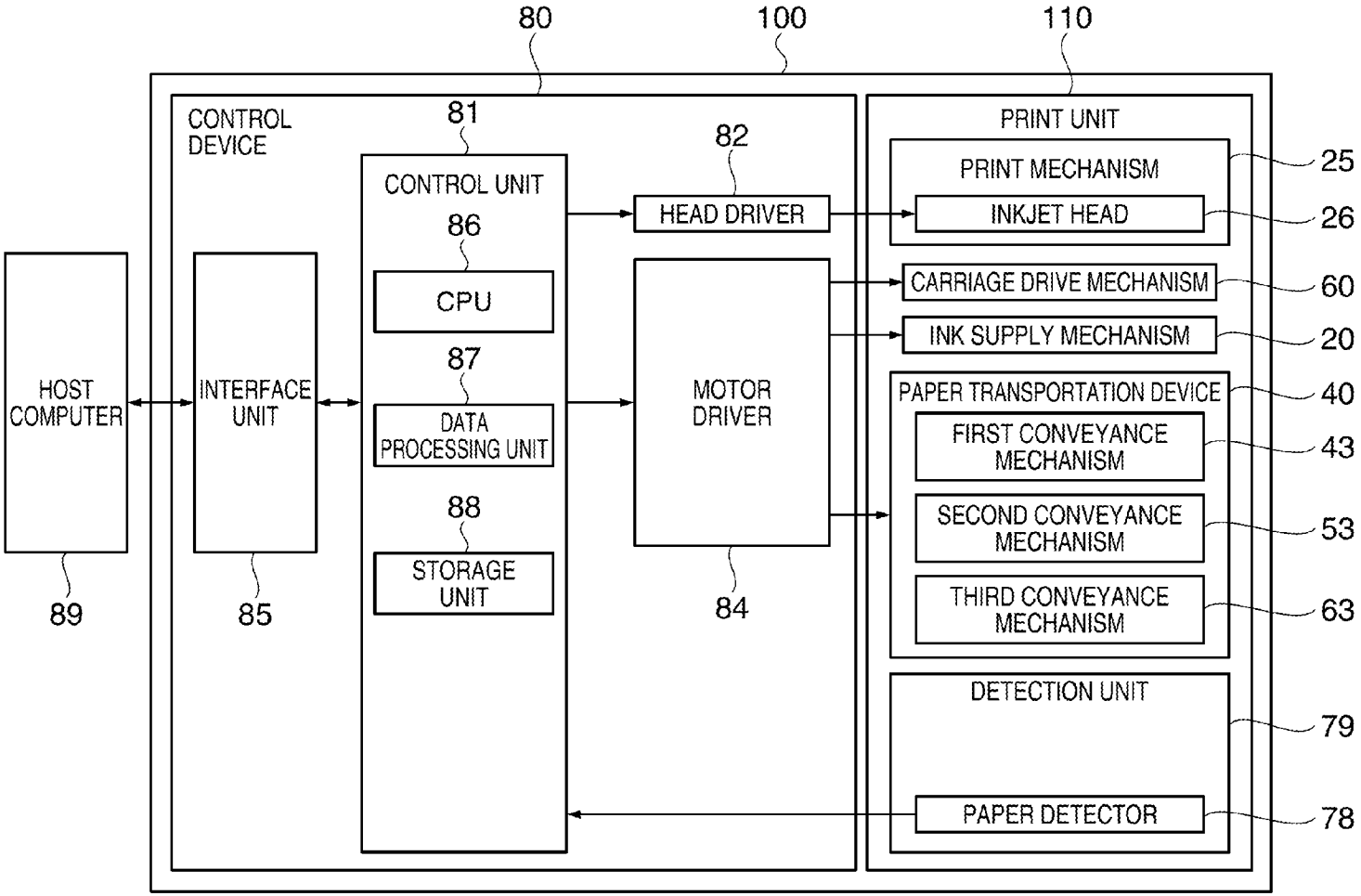
FIG. 7 is a block diagram showing the main components of an inkjet printer.

The control system of the inkjet printer is described next with reference to FIG. 7. FIG. 7 is a block diagram showing the main components of the inkjet printer. As shown in FIG. 7, the inkjet printer 100 has a print unit 110 that includes a print mechanism 25 including the inkjet head 26, a carriage drive mechanism 60 including a carriage motor not shown, a paper conveyance device 40, and a detection unit 79 including a paper detector 78, and a control device 80 that centrally controls these other parts.

The control device 80 includes a control unit 81 that is the main part of the control system, a head driver 82 that controls driving the inkjet head 26, a motor driver 84 that drives the ink supply mechanism 20, paper conveyance device 40, and carriage drive mechanism 60, and an interface unit 85. The control unit 81 includes a CPU (central processing unit) 86, data processing unit 87, and storage unit 88. The CPU 86 executes processes including processing input signals from a detection system and an operating system not shown, and a printing process. The data processing unit 87 processes information.

The storage unit 88 is rendered by RAM (random access memory), ROM (read-only memory), or other device not shown. RAM is used to temporarily store print data and other data input from the host computer 89 through the interface unit 85, and temporarily stores printing process and other programs that are executed by the CPU 86. The print data describes the pattern to be printed on continuous paper R by the inkjet head 26.

The head driver 82 controls the inkjet head 26 based on commands from the CPU 86. The motor driver 84 individually controls the motors of the paper conveyance device 40 and carriage drive mechanism 60 based on commands from the CPU 86. The interface unit 85 outputs print data, for example, received from the host computer 89 to the control unit 81, and outputs data received from the control unit 81 to the host computer 89.

The inkjet printer 100 configured as described above prints on the continuous prescription bag paper 90A by alternately performing a paper feed operation that conveys the continuous prescription bag paper 90A in specific paper feed increments along the x-axis shown in FIG. 1 by means of the paper conveyance device 40, and a printing operation that prints by means of the carriage drive mechanism 60 moving the inkjet head 26 bidirectionally on the y-axis perpendicularly to the paper feed direction. The printed prescription bags 90 are individually separated at a perforation 94.

Inkjet Printer Operation

The operation of the inkjet printer described above, and particularly conveyance of continuous paper, is described next with reference to FIG. 8. FIG. 8 describes conveyance of continuous paper in this first embodiment of the invention, FIG. 8A being a section view through G1 in FIG. 4A, FIG. 8B being a section view through G2 in FIG. 4A, FIG. 8C being a section view through G3 in FIG. 4A, and FIG. 8D being a section view through G4 in FIG. 4A. Note that the x-axis, y-axis, and z-axis shown in FIG. 8 denote the same directions as the x-axis, y-axis, and z-axis shown in FIG. 1. In addition, using continuous prescription bag paper 90A as the continuous paper R is described in the following example.

Inkjet printer 100 operation includes a paper loading step S1, paper conveyance step S2, and printing step S3.

In the paper loading step S1, the continuous prescription bag paper 90A shown in FIG. 6B is set in the paper conveyance device 40 of the inkjet printer 100. More specifically, the sprocket holes Q1 formed along the edges 90*a*, 90*b* of the continuous prescription bag paper 90A are mounted on the tractor pins 45 that are formed on the tractor belts 46 of the tractors 44 as the first conveyance mechanism 43.

In the paper conveyance step S2, the paper feed motor 72 is driven based on control signals from the motor driver 84 of the control unit 81 shown in FIG. 7, and drive power is transferred from the motor gear 71 shown in FIG. 4 through the toothed belt 74 to the drive gear 42 of the first conveyance mechanism 43 and the drive gear 52 of the second conveyance mechanism 53. Drive power is also transferred from the drive gear 52 of the second conveyance mechanism 53 to the drive gear 62 of the third conveyance mechanism 63. As a result, the tractor belts 46 turn, the tractor pins 45 of the tractor belts 46 sequentially engage the sprocket holes Q1 of the continuous prescription bag paper 90A, and the continuous prescription bag paper 90A is conveyed through the paper conveyance path 41. The continuous prescription bag paper 90A thus reaches the guide unit 30.

Figure 8A:
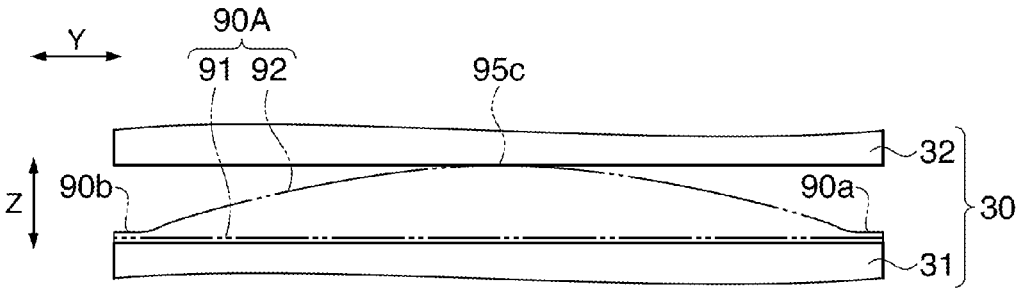
FIG. 8 illustrates conveyance of fanfold paper in the first embodiment of the invention.

As shown in FIG. 6A and described above, the continuous prescription bag paper 90A has a two-part structure including a transparent plastic film sheet 91 and cover sheet 92 made from different materials, and both edges 90*a*, 90*b* at the width (y-axis sides) of the paper are bonded by adhesive. As a result, the sheets have different expansion rates and particularly in a high humidity environment the paper expands and bulges to the side with the higher expansion rate as shown in FIG. 8A. When the humidity is from approximately 65% to 80%, the cover sheet 92 tends to pucker 95*c* to the side that is printed on (z-axis) across the paper width (y-axis). When the inkjet printer 100 attempts to print on the continuous prescription bag paper 90A, this puckering 95*c* prevents maintaining a desirable gap to the inkjet head 26, and print quality drops. If a roller type paper feed mechanism is used in the conveyance direction of the continuous prescription bag paper 90A, the bulge 95*c* will be crushed by the rollers and form creased wrinkles in the center.

Figure 8B:
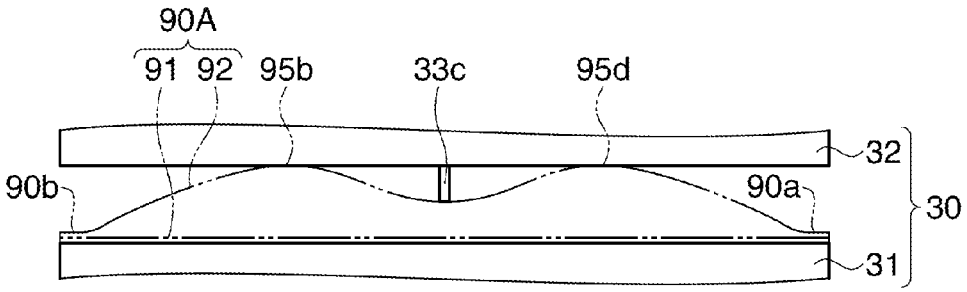

The guide unit 30 functions to correct this puckering of the continuous prescription bag paper 90A. As shown in FIG. 8A, the continuous prescription bag paper 90A is conveyed in the x-axis direction while bulging 95*c* toward the guide unit 30 between the bottom guide 31 and top guide 32. As shown in FIG. 8B, the conveyed continuous prescription bag paper 90A first meets the rib 33*c* disposed in the y-axis center of the top guide 32, and this rib 33*c* deflates the peak of the bulge 95*c* and forms two bulges 95*b* and 95*d* on opposite sides thereof on the y-axis.

Figure 8C:
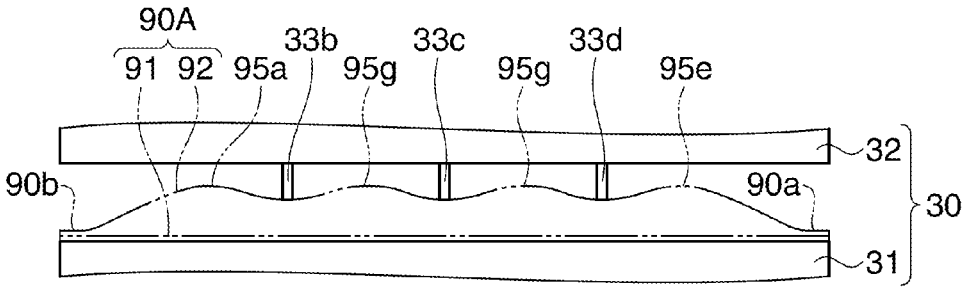

As shown in FIG. 8C, the conveyed continuous prescription bag paper 90A remains in contact with the rib 33*c* while the bulges 95*b* and 95*d* are deflated by the ribs 33*b*, 33*d* of the top guide 32 on the right and left y-axis sides of rib 33*c*, forming two bulges 95*a*, 95*e* along the outside y-axis edges. An even smaller bulge 95*g* is formed is formed between the rib 33*b* and rib 33*c* and between rib 33*c* and rib 33*d*.

Figure 8D:
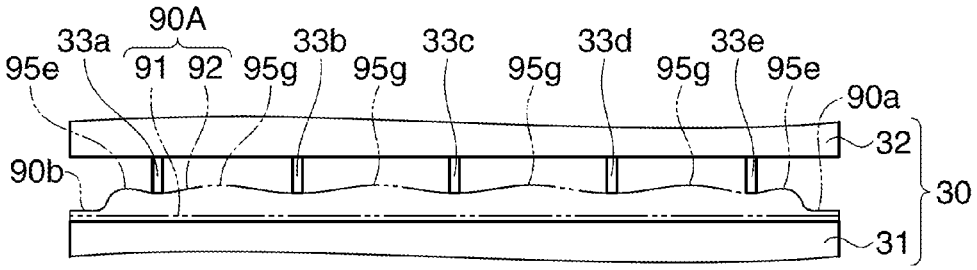

As shown in FIG. 8D, as the continuous prescription bag paper 90A is conveyed further in contact with ribs 33*b*, 33*c*, and 33*d*, the bulges 95*a*, 95*e* are deflated by the ribs 33*a* and 33*e* disposed outside ribs 33*b*, 33*d* of the top guide 32 on the y-axis, forming two small bulges 95*e* on both sides on the y-axis.

As described above, the large bulge 95*c* in the continuous prescription bag paper 90A is deflated as it travels over the guide unit 30, and is gradually broken down into smaller bulges (bubbles) by the rib 33*c*, ribs 33*b*, 33*d*, and ribs 33*a* and 33*e* disposed on the puckered side. As a result, when the continuous prescription bag paper 90A passes over the guide unit 30, there are small bulges 95*f* and 95*g* in the continuous prescription bag paper 90A.

The prescription bag 90 conveyed through the paper conveyance path 41 then reaches the second conveyance mechanism 53. The continuous prescription bag paper 90A reaching the second conveyance mechanism 53 is then guided to and held and conveyed by the nipping part of the rotating first paper feed roller 55 and first pressure roller 58 of the second conveyance mechanism 53. As shown in FIG. 4A, the first pressure roller 58 includes a plurality of rollers 59, and a roller shaft 54 passing axially through the plural rollers 59. As described above, the roller 59 is segmented into five rollers 59*a*, 59*b*, 59*c*, 59*d*, 59*e*.

As described above, roller 59*a* is disposed opposite rib 33*a*, roller 59*b* is disposed opposite rib 33*b*, roller 59*c* is disposed opposite rib 33*c*, roller 59*d* is disposed opposite rib 33*d*, and roller 59*e* is disposed opposite rib 33*e*. As a result, rollers 59*a*, 59*b*, 59*c*, 59*d*, and 59*e* can avoid the locations of bulges 95*f*, 95*g*, which are small bubbles in the continuous prescription bag paper 90A.

The continuous prescription bag paper 90A conveyed by the second conveyance mechanism 53 passes the printing position A of the inkjet head 26, and reaches the third conveyance mechanism 63. The continuous prescription bag paper 90A that reaches the third conveyance mechanism 63 is conveyed toward the paper exit 14 by the rotating second paper feed roller 65 and second pressure roller 68 of the third conveyance mechanism 63. The leading end and presence of the conveyed continuous prescription bag paper 90A are also detected by the paper detector 78 disposed on the paper exit 14 side of the first paper feed roller 55.

In the printing step S3, ink is discharged as ink droplets from the nozzles 27 of the inkjet head 26 onto the printing surface of the continuous prescription bag paper 90A, which is corrected by the guide unit 30 as the paper is conveyed by the paper conveyance device 40, while the inkjet head 26 moves bidirectionally on the y-axis perpendicularly to the paper feed direction by means of the carriage drive mechanism 60 of the print mechanism 25 to print information such as text or images.

The effect of this embodiment of the invention is described next.

(1) The paper conveyance device 40 according to this embodiment of the invention can flatten and break even a large bulge 95*c* into multiple small bulges 95*f*, 95*g* even in a two-part continuous prescription bag paper 90A with a single large bulge 95*c* by passing the paper 90A through a guide unit 30 with multiple ribs 33*a*, 33*b*, 33*c*, 33*d*, and 33*e* of different lengths. As a result, an appropriate gap can be maintained between the inkjet head 26 and the continuous prescription bag paper 90A. The inkjet printer 100 can therefore maintain good print quality.

(2) The 40 can correct bulges 95*c*, which are bubbles, in the continuous prescription bag paper 90A by means of a simple structure having a plurality of ribs 33*a*, 33*b*, 33*c*, 33*d*, and 33*e* of different lengths disposed to the guide unit 30 passed which the continuous prescription bag paper 90A is conveyed.

(3) The paper conveyance device 40 described above divides and smoothes bulges 95*c*, which are bubbles in the continuous prescription bag paper 90A, by means of plural ribs 33*a*, 33*b*, 33*c*, 33*d*, and 33*e* of different lengths, and divides the first pressure roller 58 of the second conveyance mechanism 53 into a plurality of rollers 59*a*, 59*b*, 59*c*, 59*d*, 59*e* that are disposed opposite the respective ribs 33. More specifically, the rollers 59 of the first pressure roller 58 can be located at positions outside the bulges 95*f*, 95*g*. As a result, the bulges 95*f*, 95*g* of the continuous prescription bag paper 90A can be prevented from being crushed and creased into wrinkles by the roller 59. A drop in print quality due to creased wrinkles in the continuous paper can therefore be prevented.

Embodiment 2

A paper conveyance device according to a second embodiment of the invention is described next with reference to FIG. 3, FIG. 5, and FIG. 9. FIG. 9 describes a guide unit according to a second embodiment of the invention. Note that like parts and content in this and the first embodiment described above are identified by like reference numerals, and further description thereof is omitted or simplified.

The paper conveyance device 140 according to the second embodiment of the invention is the same as the paper conveyance device 40 of the first embodiment except that the configuration of the guide unit 130 differs from the guide unit 30 described above. More specifically, this paper conveyance device 140 includes the paper conveyance path 41, a guide unit 130, first conveyance mechanism 43, second conveyance mechanism 53, third conveyance mechanism 63, and power transfer mechanism 70 (see FIG. 5). Similarly to the paper conveyance device 40 of the first embodiment, the paper conveyance device 140 according to the second embodiment conveys the continuous paper R shown in FIG. 6 through the guide unit 130 of the paper conveyance path 41 to the paper exit 14 by means of the first conveyance mechanism 43, second conveyance mechanism 53, and third conveyance mechanism 63, which are powered by the power transfer mechanism 70.

Figure 9A:
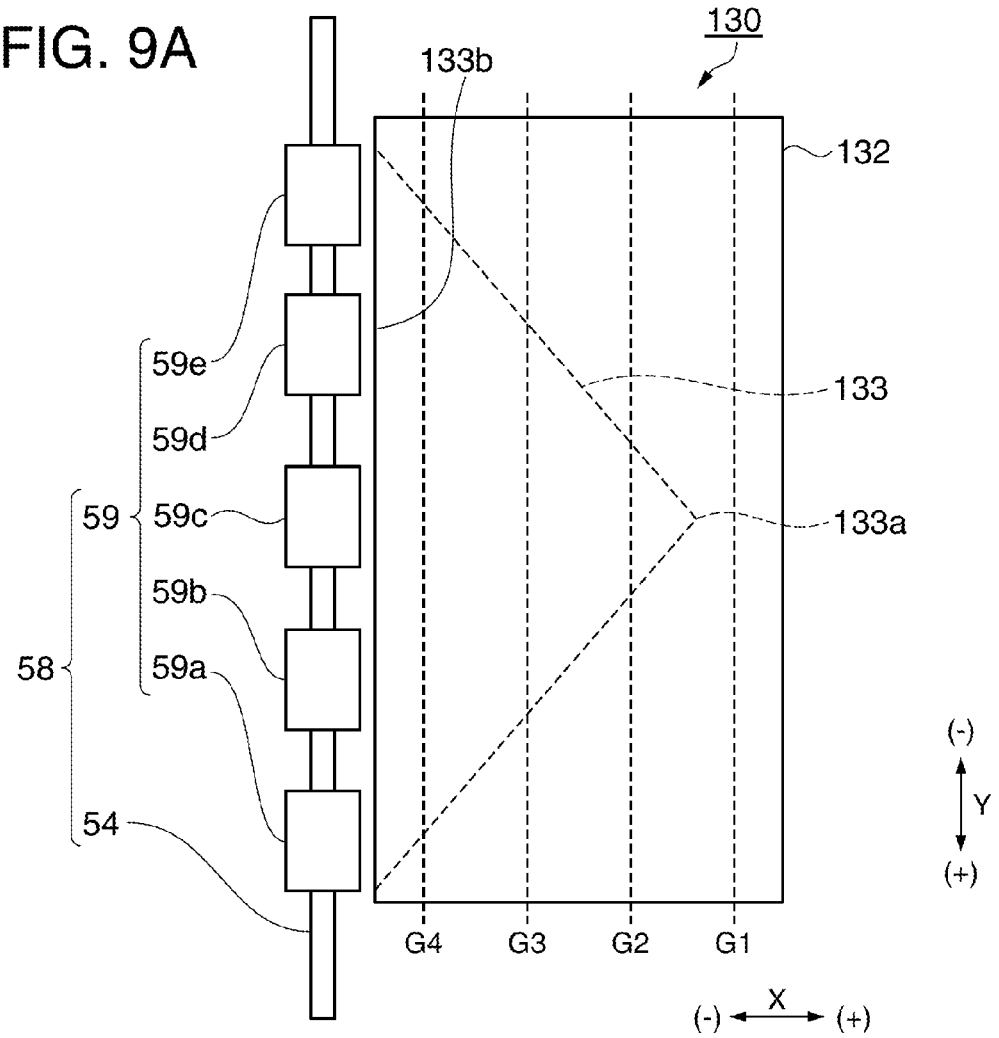
FIG. 9 describes the guide unit in a second embodiment of the invention.

As shown in FIG. 3 and FIG. 9, the guide unit 130 has a bottom guide 131 that guides the bottom surface Ra of the conveyed continuous paper R, and a top guide 132 that guides the top surface Rb of the continuous paper R and is disposed opposite the bottom guide 131 with a specific gap therebetween on the z-axis. A shoulder 133 is disposed to the top guide 132 as a stepped surface reducing the gap to the bottom guide 131. As shown in FIG. 9A, the shoulder 133 in this second embodiment of the invention is triangular with a peak 133*a* near the center of the paper width on the upstream side (X(+) direction) in the conveyance direction of the conveyed continuous paper R, and the base 133*b* at the end on the downstream side in the conveyance direction near the X(−) side.

Figure 9B:
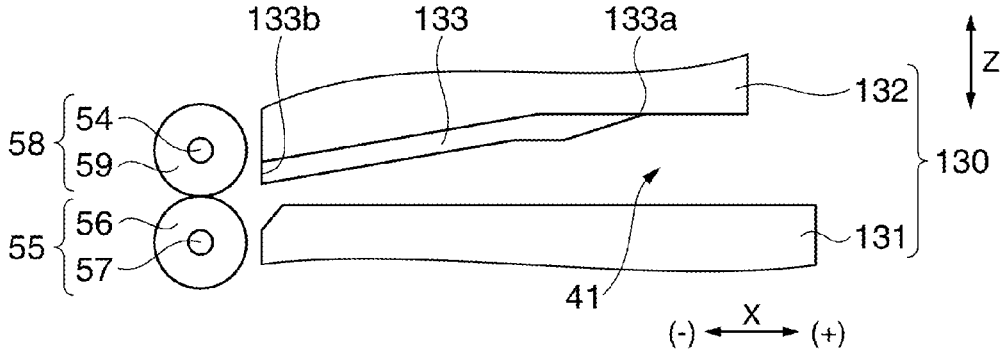

As shown in FIG. 9B, the surface of the shoulder 133 disposed to the top guide 132 slopes so that the gap to the bottom guide 131 decreases from the X(+) side to the X(−) side in the main conveyance direction of the continuous paper R. The continuous paper R is conveyed passed this guide unit 130 through the paper conveyance path 41.

Inkjet Printer Operation

The operation of the inkjet printer described above, and particularly conveyance of continuous paper, is described next with reference to FIG. 10. FIG. 10 describes conveyance of continuous paper in this first embodiment of the invention, FIG. 10A being a section view through G1 in FIG. 4A, FIG. 10B being a section view through G2 in FIG. 4A, FIG. 10C being a section view through G3 in FIG. 4A, and FIG. 10D being a section view through G4 in FIG. 4A. Note that the x-axis, y-axis, and z-axis shown in FIG. 10 denote the same directions as the x-axis, y-axis, and z-axis shown in FIG. 1. In addition, using continuous prescription bag paper 90A as the continuous paper R is described in the following example.

Inkjet printer 100 operation includes a paper loading step S1, paper conveyance step S2, and printing step S3.

In the paper loading step S1, the continuous prescription bag paper 90A shown in FIG. 6B is set in the paper conveyance device 40 of the inkjet printer 100. More specifically, the sprocket holes Q1 formed along the edges 90*a*, 90*b* of the continuous prescription bag paper 90A are mounted on the tractor pins 45 that are formed on the tractor belts 46 of the tractors 44 as the first conveyance mechanism 43.

In the paper conveyance step S2, the paper feed motor 72 is driven based on control signals from the motor driver 84 of the control unit 81 shown in FIG. 7, and drive power is transferred from the motor gear 71 shown in FIG. 4 through the toothed belt 74 to the drive gear 42 of the first conveyance mechanism 43 and the drive gear 52 of the second conveyance mechanism 53. Drive power is also transferred from the drive gear 52 of the second conveyance mechanism 53 to the drive gear 62 of the third conveyance mechanism 63. As a result, the tractor belts 46 turn, the tractor pins 45 of the tractor belts 46 sequentially engage the sprocket holes Q1 of the continuous prescription bag paper 90A, and the continuous prescription bag paper 90A is conveyed through the paper conveyance path 41. The continuous prescription bag paper 90A thus reaches the guide unit 30.

Figure 10A:
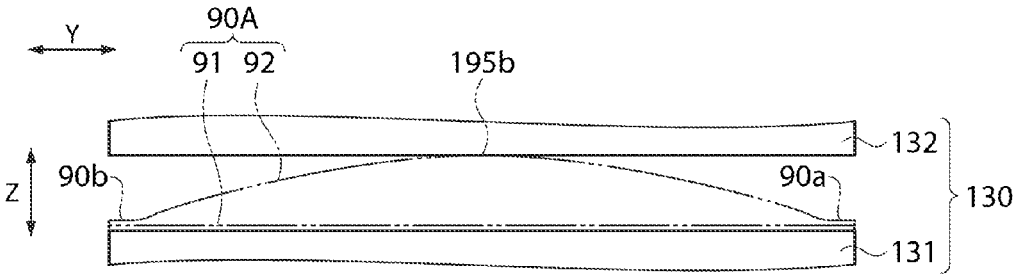
FIG. 10 illustrates conveyance of fanfold paper in the second embodiment of the invention.

As described above, the continuous prescription bag paper 90A has a two-part structure including a transparent plastic film sheet 91 and cover sheet 92 made from different materials, and both edges 90*a*, 90*b* at the width (y-axis sides) of the paper are bonded by adhesive. As a result, the sheets have different expansion rates and particularly in a high humidity environment the paper expands and puckers to the side with the higher expansion rate as shown in FIG. 10A. When the humidity is from approximately 65% to 80%, the cover sheet 92 tends to bulge 195*b* to the side that is printed on (z-axis) across the paper width (y-axis). When the inkjet printer 100 attempts to print on the continuous prescription bag paper 90A, this bulging 195*b* prevents maintaining a desirable gap to the inkjet head 26, and print quality drops. If a roller type paper feed mechanism is used in the conveyance direction of the continuous prescription bag paper 90A, the bulge 195*b* will be crushed by the rollers and form creased wrinkles in the center.

Figure 10B:
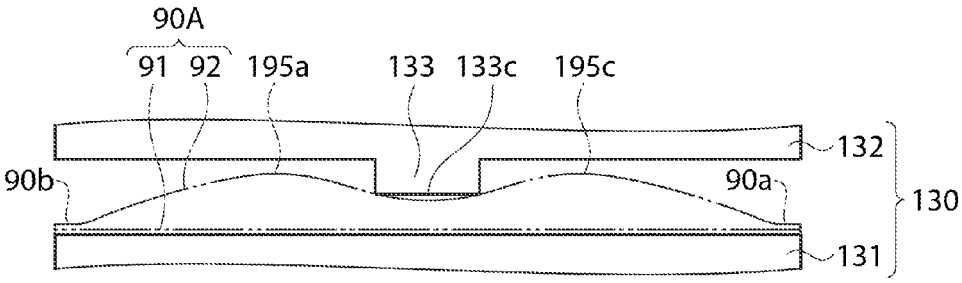

The guide unit 130 functions to correct this bulging of the continuous prescription bag paper 90A. As shown in FIG. 10A, the continuous prescription bag paper 90A reaching the guide unit 130 with a bulge 195*b* is conveyed in the x-axis direction between the bottom guide 131 and top guide 132. As shown in FIG. 10B, the conveyed continuous prescription bag paper 90A first meets the peak 133*a* of the shoulder 133 in the middle of the top guide 132 on the y-axis, the top of the bulge 195*b* is deflated by the shoulder face 133*c* starting from the peak 133*a*, and two bulges 195*a* and 195*c* are formed on opposite sides thereof on the y-axis.

Figure 10C:
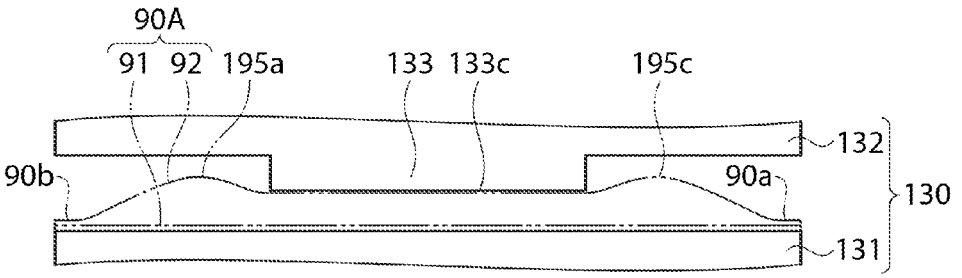
Figure 10D:
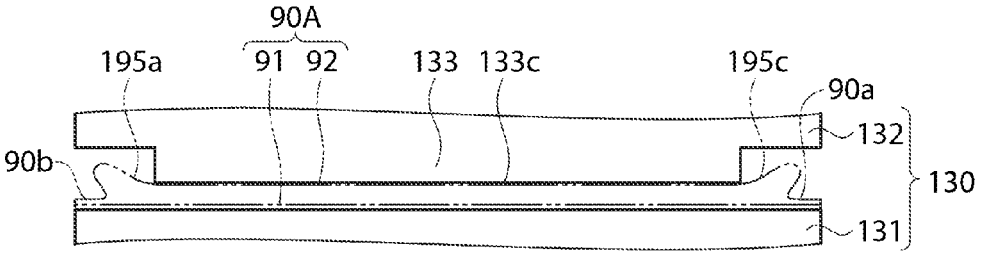

As shown in FIG. 10C, the continuous prescription bag paper 90A is conveyed in contact with the face 133*c* of the shoulder 133, which is triangular when seen in plan view. As a result, the two bulges 195*a* and 195*c* are gradually pushed out to the sides of the continuous prescription bag paper 90A by the shoulder face 133*c* of the shoulder 133 as the continuous prescription bag paper 90A is conveyed. In addition, the two bulges 195*a* and 195*c* of the conveyed continuous prescription bag paper 90A are moved to the sides of the continuous prescription bag paper 90A by the shoulder face 133*c* of the shoulder 133 as shown in FIG. 10D. As a result, when the continuous prescription bag paper 90A passes the guide unit 130, the continuous prescription bag paper 90A is flattened in the middle where the print area is located, and the bulges 195*a* and 195*c* are moved to the areas at the sides that are not printed.

The prescription bag 90 conveyed through the paper conveyance path 41 then reaches the second conveyance mechanism 53. The continuous prescription bag paper 90A reaching the second conveyance mechanism 53 is then guided to and held and conveyed by the rotating first paper feed roller 55 and first pressure roller 58 of the second conveyance mechanism 53. As shown in FIG. 9A, the first pressure roller 58 includes a plurality of rollers 59, and a roller shaft 54 passing axially through the plural rollers 59. As described above, the roller 59 is segmented into five rollers 59*a*, 59*b*, 59*c*, 59*d*, 59*e*.

The continuous prescription bag paper 90A conveyed by the second conveyance mechanism 53 passes the printing position A of the inkjet head 26, and reaches the third conveyance mechanism 63. The continuous prescription bag paper 90A that reaches the third conveyance mechanism 63 is conveyed toward the paper exit 14 by the rotating second paper feed roller 65 and second pressure roller 68 of the third conveyance mechanism 63. The leading end and presence of the conveyed continuous prescription bag paper 90A are also detected by the paper detector 78 disposed on the paper exit 14 side of the first paper feed roller 55.

In the printing step S3, ink is discharged as ink droplets from the nozzles 27 of the inkjet head 26 onto the printing surface of the continuous prescription bag paper 90A, which is corrected by the guide unit 30 as the paper is conveyed by the paper conveyance device 40, while the inkjet head 26 moves bidirectionally on the y-axis perpendicularly to the paper feed direction by means of the carriage drive mechanism 60 of the print mechanism 25 to print information such as text or images.

The effect of this second embodiment of the invention is described below.

(1) The paper conveyance device 140 according to this embodiment of the invention can break a large bulge 195*b* in the print area into two small bulges 195*a*, 195*c* that are moved to the non-printing area on the widthwise sides of the medium even in a two-part continuous prescription bag paper 90A with a single large bulge 195*b* by passing the paper 90A through a guide unit 130 with a shoulder 133 surface that is triangular in plan view. As a result, an appropriate gap can be maintained between the inkjet head 26 and the continuous prescription bag paper 90A. The inkjet printer 100 can therefore maintain good print quality.

(2) The paper conveyance device 140 can correct a bulge 195*b*, which is a bubble, in the continuous prescription bag paper 90A using the simple configuration of a triangular shoulder 133 rendered on the guide unit 130 over which the continuous prescription bag paper 90A is conveyed.

Preferred embodiments of the invention are described above, but the invention is not limited thereto and can be varied in many ways without departing from the scope of the accompanying claims. Examples of such variations are described below.

Variation 1

The shape and number of ribs 33 described in the foregoing embodiment are not so limited, and can be varied in many ways. For example, the shape and number of the ribs 33 can be changed appropriately according to the size of the continuous paper R and the type of sheets used as the recording medium. The invention is also described as using continuous paper R as the recording medium, but the invention is not so limited. For example, individual prescription bag media 90 can be used.

An inkjet printer 100 is also used as an example of the printing device, but the invention is not so limited. The printer may be a dot impact printer, a solid font impact printer, or a thermal printer, for example.

Variation 2

The shape and height of the shoulder 133 described in the second embodiment are used by way of example, and are not so limited. For example, the shape and height of the shoulder 133 can be changed appropriately according to the size of the continuous paper R and the type of sheets used as the recording medium. The invention is also described as using continuous paper R as the recording medium, but the invention is not so limited. For example, individual prescription bag media 90 can be used.

An inkjet printer 100 is also used as an example of the printing device, but the invention is not so limited. The printer may be a dot impact printer, a solid font impact printer, or a thermal printer, for example.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A paper conveyance device for a printing device that prints information using a printhead on conveyed continuous paper, comprising:

a paper conveyance mechanism having a paper feed roller and a pressure roller that hold and convey the continuous paper to the print area of a printhead; and a guide unit located upstream from the printhead that has two planar guide surfaces opposite each other and facing the continuous paper conveyed therebetween by the paper conveyance mechanism, and a plurality of ribs that are disposed to at least one of the two planar guide surfaces with a specific gap therebetween in the direction perpendicular to the conveyance direction, protrude to the continuous paper side, and extend in the conveyance direction, the rib located in the middle of the width of the conveyed continuous paper being the longest of the plural ribs in the conveyance direction, and the length in the conveyance direction of the other ribs becoming gradually shorter with proximity to the sides of the continuous paper width.

2. The paper conveyance device described in claim 1, wherein:

the plural ribs sequentially include the rib located in the center of the continuous paper width as a first rib, two second ribs that are shorter than the first rib disposed with a specific gap to the first rib in the direction perpendicular to the continuous paper conveyance direction, and two third ribs that are shorter than the second ribs disposed with a specific gap to the second ribs in the direction perpendicular to the continuous paper conveyance direction.

3. The paper conveyance device described in claim 1, wherein:

of the two guide surfaces of the guide unit, the plural ribs are disposed to the guide surface opposite the printing surface of the continuous paper.

4. The paper conveyance device described in claim 1, wherein:

the gap between the ribs and the other guide surface decreases in the main conveyance direction of the continuous paper.

5. The paper conveyance device described in claim 1, wherein:

the pressure roller of the paper conveyance mechanism is segmented into a plurality of rollers across the width of the conveyed continuous paper; and the plural rollers are disposed to positions corresponding to the plural ribs rendered on the guide surface.

6. The paper conveyance device described in claim 1, wherein:

the continuous paper is composed of two sheets that are bonded by adhesive at the widthwise edges.

7. The paper conveyance device described in claim 1, wherein:

the continuous paper is composed of two sheets of different materials that are bonded by adhesive at the widthwise edges.

8. A printing device comprising:

the paper conveyance device described in claim 1;

a printhead that discharges ink droplets onto continuous paper conveyed by the paper conveyance device;

a carriage that carries the printhead; and a carriage moving mechanism that moves the carriage bidirectionally perpendicularly to the conveyance direction of the paper conveyance device.

9. A paper conveyance device for a printing device that prints information using a printhead on conveyed continuous paper, comprising:

a paper conveyance mechanism that conveys the continuous paper to the area where the printhead is located; and a guide unit located upstream from the printhead that has two planar guide surfaces opposite each other and facing the continuous paper conveyed therebetween by the paper conveyance mechanism, and a shoulder that is disposed to at least one of the two planar guide surfaces, protrudes to the continuous paper side, and has a continuous paper contact area that when seen in plan view has a peak on the upstream side in the conveyance direction and gradually increases in the downstream direction.

10. The paper conveyance device described in claim 9, wherein:

of the two guide surfaces of the guide unit, the shoulder is disposed to the guide surface opposite the printing surface of the continuous paper.

* * * * *